United States Patent [19]

Duerring

[11] Patent Number: 4,955,220

[45] Date of Patent: Sep. 11, 1990

[54] LOW INERTIA MECHANISM FOR REPOSITIONING A WORKPIECE IN A ROCKER MILL

[75] Inventor: Anthony A. Duerring, Kennewick, Wash.

[73] Assignee: Sandvik Special Metals Corporation, Kennewick, Wash.

[21] Appl. No.: 440,101

[22] Filed: Nov. 22, 1989

[51] Int. Cl.[5] ..... B21B 21/04

[52] U.S. Cl. ..... 72/214; 72/208

[58] Field of Search ..... 72/21, 22, 208, 214, 72/250

[56] References Cited

U.S. PATENT DOCUMENTS

| | | | |
|---|---|---|---|
| 2,192,808 | 3/1940 | Bungelaar | 72/214 |
| 3,030,835 | 4/1962 | Krause | 72/214 |
| 3,167,671 | 1/1965 | Staak . | |
| 3,673,840 | 7/1972 | Tselikov et al. . | |
| 3,680,345 | 8/1972 | Tselikov et al. . | |
| 3,698,225 | 10/1972 | Peytavin . | |
| 3,753,370 | 8/1973 | Sporck . | |
| 3,777,534 | 12/1973 | Sherman et al. . | |
| 3,948,070 | 4/1976 | Hentzschel et al. . | |
| 4,019,394 | 4/1977 | Peytavin . | |
| 4,398,109 | 8/1983 | Kuwako et al. . | |
| 4,562,713 | 1/1986 | Kondoh . | |
| 4,641,513 | 2/1987 | Peytavin | 72/214 |
| 4,771,624 | 9/1988 | Vorbach et al. . | |

*Primary Examiner*—Lowell A. Larson
*Assistant Examiner*—T. C. Schoeffler
*Attorney, Agent, or Firm*—Burns, Doane, Swecker & Mathis

[57] ABSTRACT

A rocker mill includes a rollstand and a carriage for supporting and repositioning a workpiece extending through the rollstand. A first hollow-shafted electric motor is mounted on the carriage and includes a first hollow open-ended rotor and threaded nut through which the stationary feedscrew passes. The threaded nut is connected to the first motor to be rotated thereby in order to move the carriage longitudinally toward the rollstand. A second hollow-shafted electric motor is mounted on the carriage and includes a second hollow open-ended rotor and a clamp through which the workpiece passes. The clamp is actuated into clamping engagement with the workpiece for transmitting rotational and longitudinal movements thereto. Such mechanism for imparting rotary and longitudinal movements to the workpiece is of very low inertia and thus is able to reposition the workpiece with a high degree of precision.

7 Claims, 5 Drawing Sheets

LOW INERTIA MECHANISM FOR REPOSITIONING A WORKPIECE IN A ROCKER MILL

BACKGROUND AND OBJECTS OF THE INVENTION

The present invention relates to precision rocker mills or pilger mills of the type which produce tubes from hollow metal workpieces.

A rocker mill is disclosed, for example in Kondoh U.S. Pat. No. 4,562,713 and in copending U.S. application Ser. No. 07/297,431 filed Jan. 17, 1989, the disclosure of which is incorporated herein by reference. Such mills typically include a movable rollstand which is reciprocated along a hollow workpiece. The rollstand includes a pair of grooved roll dies which define a nip through which the workpiece is passed so as to be radially compressed. A mandrel extends coaxially through the workpiece to radially support the inside of the workpiece.

The grooves of the roll dies are of progressively narrowing width in the circumferential direction. Thus, by rotating the roll dies during each reciprocable stroke of the rollstand, the workpiece is subjected to a progressively increasing radial compression whereby the diameter of the workpiece is progressively reduced.

At the end of each stroke it is necessary to reposition the workpiece for the next stroke. Accordingly, the workpiece is advanced longitudinally by a selected linear distance, while being rotated by a selected angular distance. Longitudinal advancement of the workpiece is accomplished by a longitudinally movable feed carriage which has a chuck or clamp that operatively engages the outer periphery of the workpiece. A feedscrew extends longitudinally of the mill and passes through a stationary threaded nut carried by the carriage. A motor is provided at one end of the feedscrew which periodically rotates the feedscrew in order to longitudinally advance the carriage and thus also the workpiece.

Rotation of the workpiece is accomplished by a plurality of motor-driven rotary clamps located in front of and behind the rollstand. The workpiece, which passes longitudinally through the rotary clamps, is gripped by the clamps, and the clamps are rotated by a selected angular distance. Likewise, a rod which is affixed to the mandrel to form a rear extension thereof passes through a clamp which grips the rod and rotates it in order to rotate the mandrel by the selected angular distance.

The above-described mechanism for longitudinally and rotationally moving the workpiece and mandrel involves an elaborate system comprised of the feedscrew and a gear-laden drive train for rotating the feedscrew and actuating the various clamps. That system is characterized by a high inertia due to its large overall weight and thus exhibits a slow reaction time upon start-up and stopping whereby it is difficult to reposition the workpiece rapidly and precisely. As a result, the rate of production and the quality of the tubes produced can be adversely affected.

SUMMARY OF THE INVENTION

The present invention involves a rocker mill including a rollstand and a repositioning apparatus for repositioning a longitudinally elongated member which includes a workpiece extending through the rollstand. The repositioning apparatus comprises a stationary feedscrew and a carriage is mounted on the guide element for movement in the longitudinal direction toward the rollstand. A first hollow-shafted electric motor is mounted on the carriage and includes a first hollow open-ended rotor through which the stationary feedscrew passes. A threaded nut is provided through which the stationary feedscrew passes. The threaded nut is connected to the first hollow-shafted electric motor to be rotated thereby relative to the feedscrew in order to move the carriage longitudinally along the guide element. A second hollow-shafted electric motor is mounted on the carriage and includes a second hollow open-ended rotor through which the elongated member is adapted to pass. A clamp is provided through which the elongated member is adapted to pass. The clamp includes displaceable clamp jaws connected to the second rotor for rotation therewith. A clamp actuating mechanism is mounted on the carriage and is operably connected to the clamp jaws for displacing the clamp jaws into clamping engagement with the elongated member for transmitting rotary forces thereto from the second rotor and for transmitting longitudinal movement thereto from the threaded nut.

DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
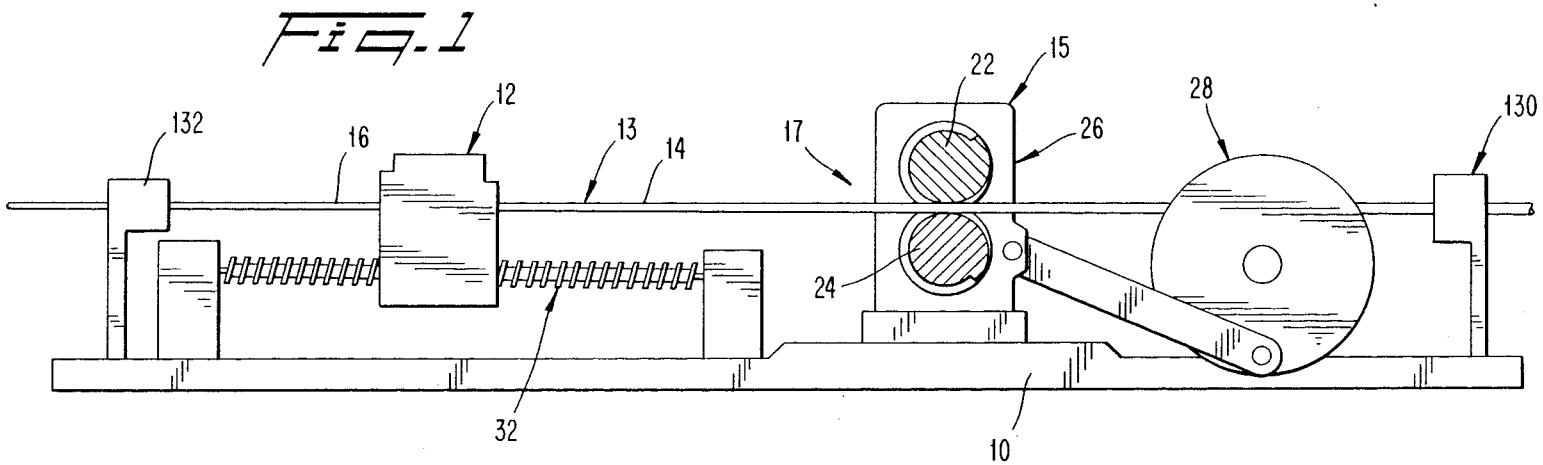
FIG. 1 is a schematic side elevational view of a rocker mill according to the present invention.

Referring to FIG. 1 of the drawing, a schematically represented rocker mill includes a stationary base 10 and a movable carriage 12. An elongated member 13 extends in a horizontal longitudinal direction through both the carriage and a movable rollstand 15 disposed in a forming zone 17 of the mill. The elongated member 13 comprises a hollow workpiece 14 and a mandrel (not shown) which is telescopingly received in the workpiece Affixed to a rear end of the mandrel is a rod 16 which forms an extension of the mandrel. The carriage functions to support, rotate, and advance the workpiece as will be explained The mandrel has an outer diameter slightly smaller than the inner diameter of the workpiece prior to arrival at the rollstand 26. The rollstand 15 comprises opposing forming rolls 22, 24 which are rotatably mounted in a reciprocable housing 26. The housing is driven by a conventional crank arm assembly 28 such that the rollstand is reciprocated horizontally with respect to the base 10 and the elongated member 13. In so doing, a nip formed by the forming rolls passes over the workpiece to reduce the diameter thereof to that of the mandrel.

In order to reposition the workpiece between successive strokes of the rollstand, the carriage 12 is arranged to rotate the workpiece and advance it in the longitudinal direction. The carriage 12 is movable toward the forming zone 17 with the aid of a feedscrew 32 that is oriented longitudinally parallel to the workpiece 14. The carriage 12 and feedscrew 32 are represented only schematically in FIG. 1. The carriage 12 is shown in detail in FIGS. 2 and 3.

Figure 2:
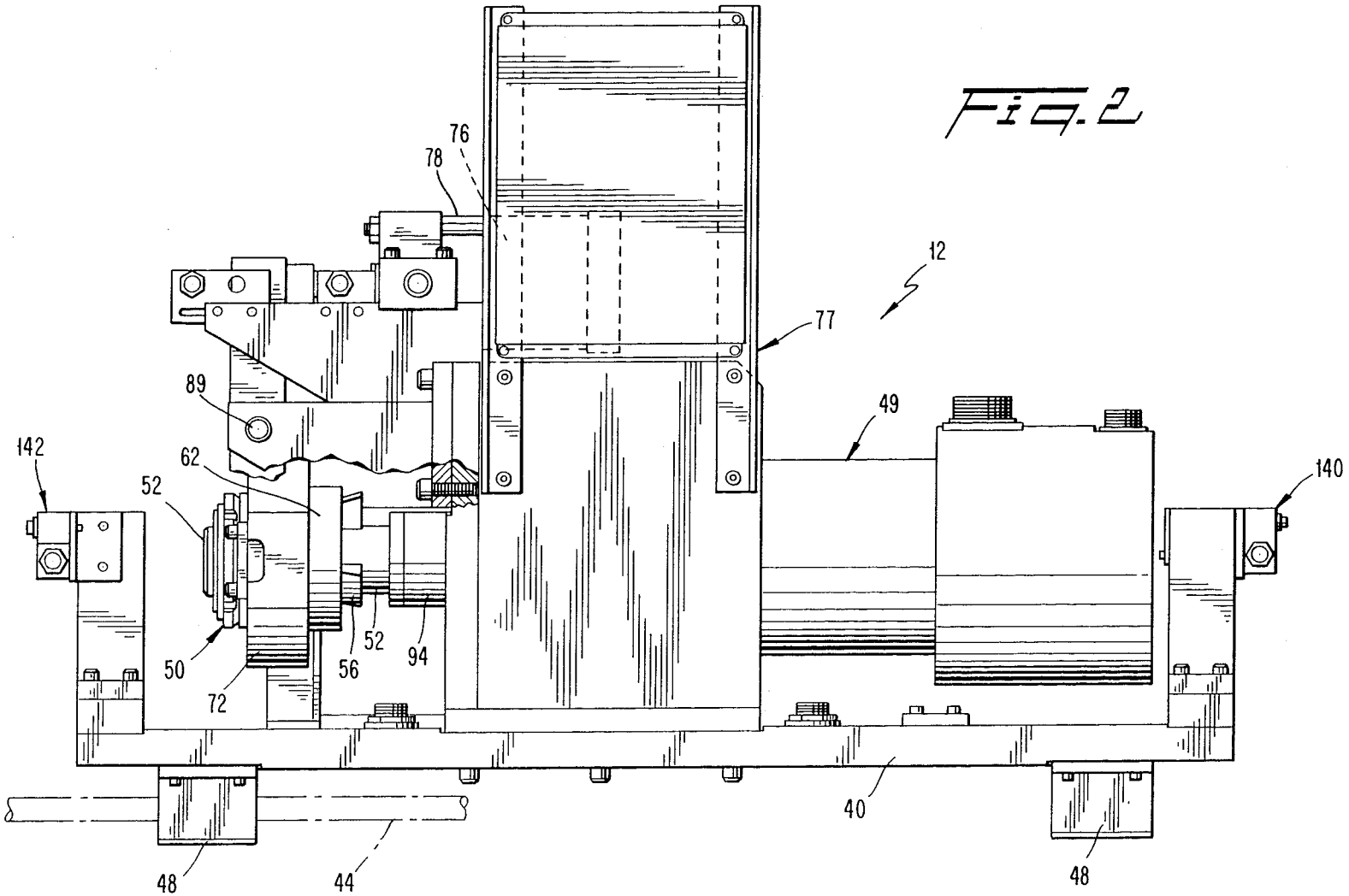
FIG. 2 is a side elevational view of a carriage portion of the rocker mill.
Figure 3:
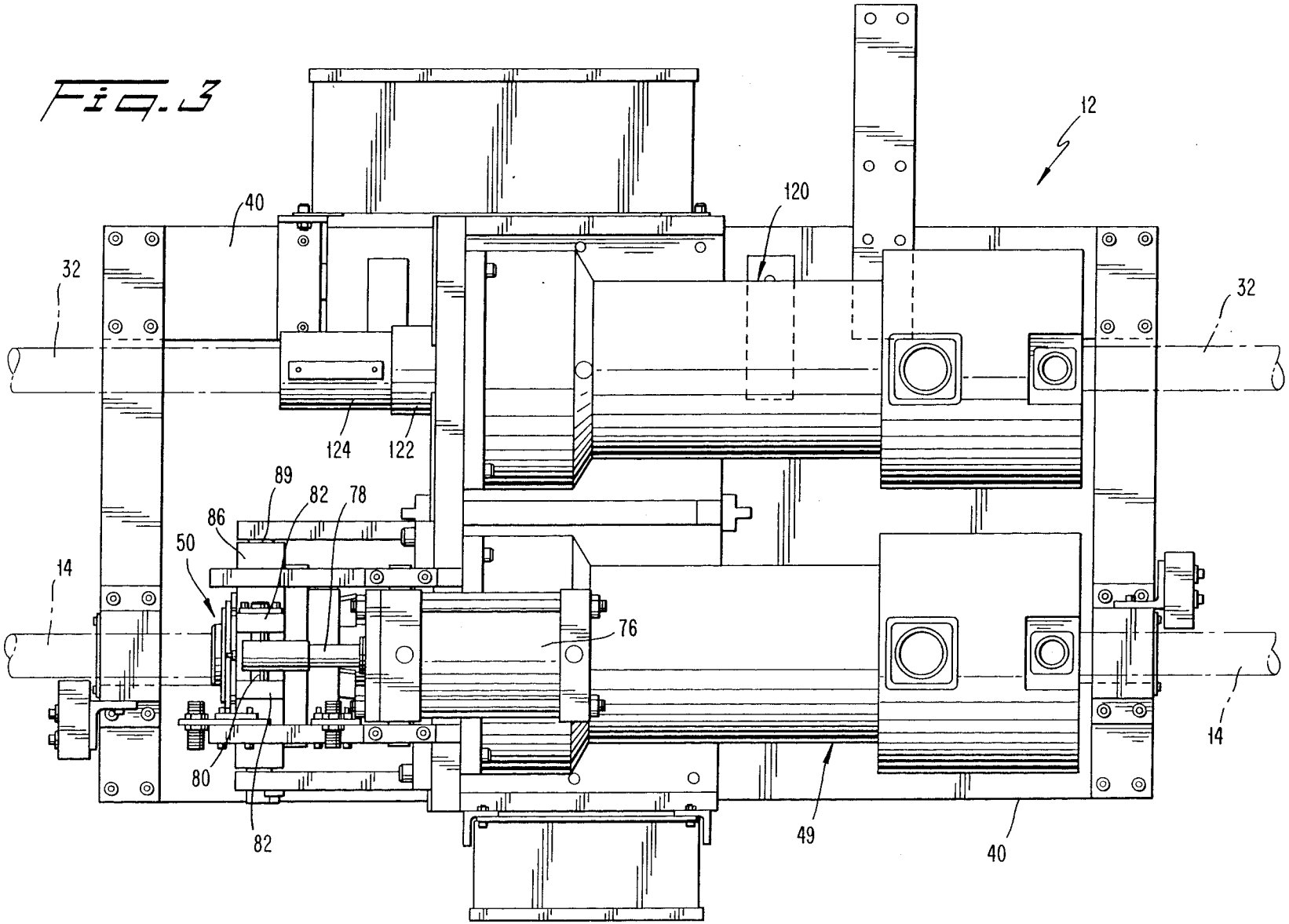
FIG. 3 is a plan view of the carriage depicted in FIG. 2.
Figure 4:
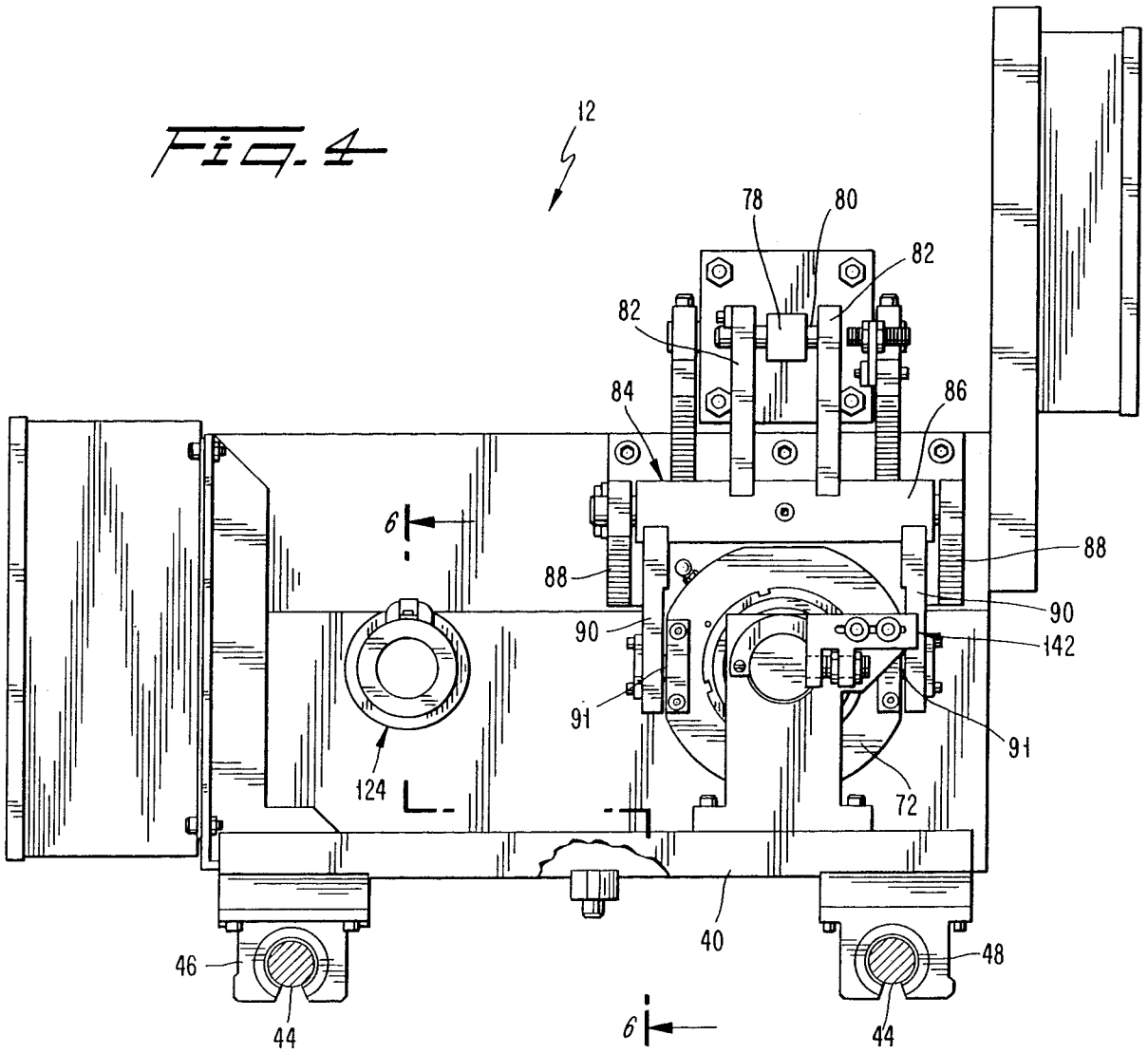
FIG. 4 is a rear end view of the carriage depicted in FIG. 2.

The carriage 12 includes a base plate 40 adapted to ride upon a pair of longitudinally extending cylindrical rails 42, 44 which are fixed to the base 10 and pass through two pairs of longitudinally aligned bushings 46 and 48 depending from an underside of the base plate. One pair of bushings 52 is shown in FIG. 2, and one bushing 46 of the other pair is shown in FIG. 4 The screw 32, the rails 42, 44, and the workpiece 14 are oriented in parallel relationship at an elevation above the base plate 10.

In accordance with the present invention the screw 32 is made stationary, and a low inertia mechanism is provided on the carriage 12 for rotating and longitudinally advancing the workpiece That mechanism includes a hollow shafted electric motor 49 which is coupled to a turning clamp 50. The turning clamp 50 includes a hollow turning shaft 52 through which the workpiece 14 coaxially passes. Disposed in the turning shaft are circumferentially spaced slots 54 which are elongated in the longitudinal direction. Mounted in respective ones of the slots 54 for radial movement are jaws 56. Each jaw 56 includes a longitudinally extending inner clamping surface 58 and an inclined outer wedge surface 60. Surrounding the jaws is an actuating collar 62 having a frusto-conical interior surface 64, the inclination of which corresponds to the inclination of the wedge surfaces 60 of the jaws.

The actuating collar 62 includes a threaded end 66 onto which a nut 68 is threaded. The nut 68 bears against a washer 70 which, in turn, bears against the collar 62 and a bearing retainer 72. The latter carries a ball bearing assembly 74, enabling the collar to rotate relative to the retainer 72.

Figure 5:
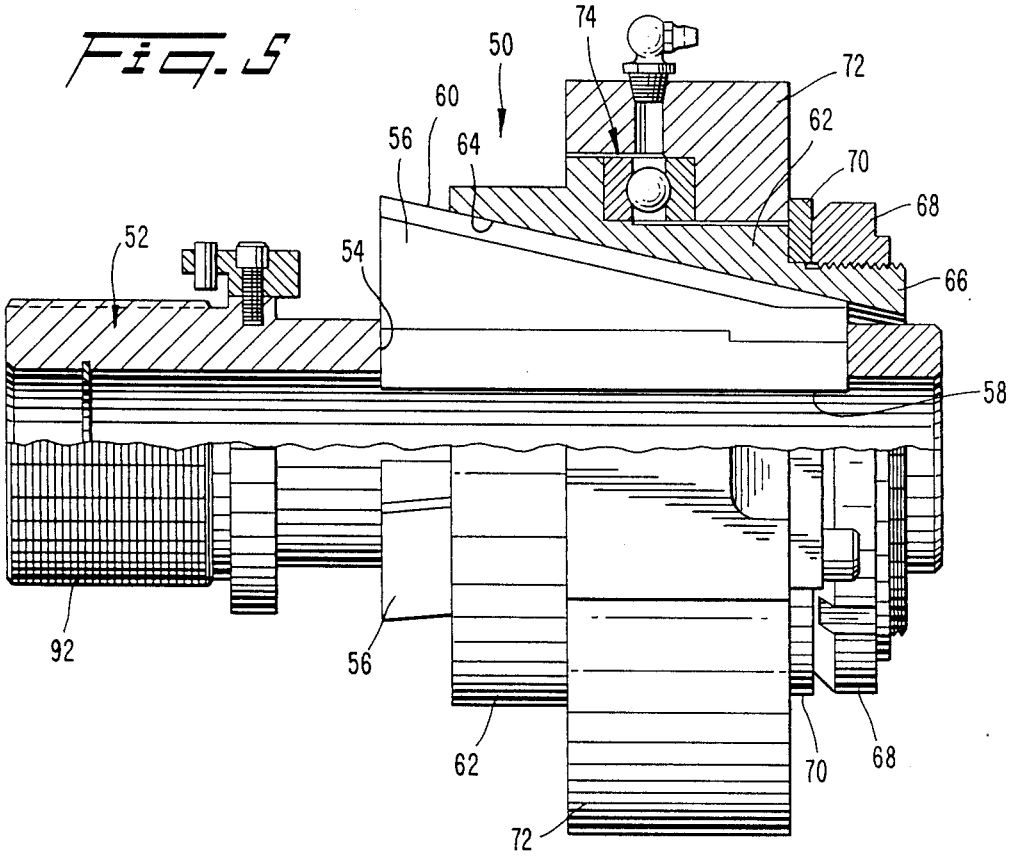
FIG. 5 is a longitudinal sectional view through a clamp mechanism.
Figure 6:
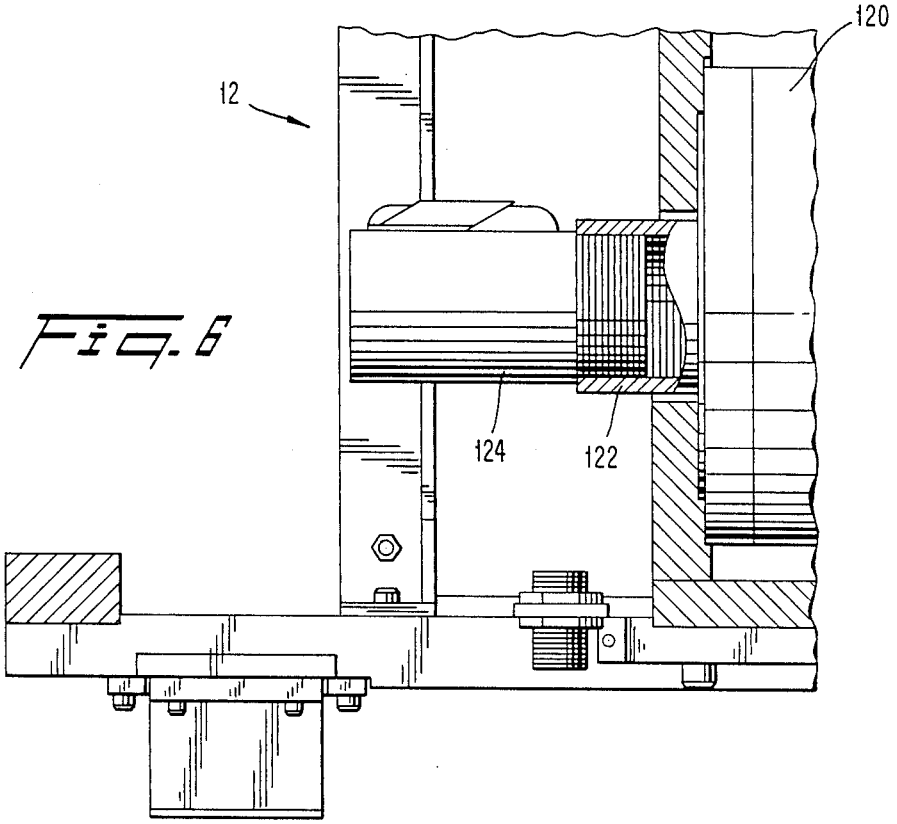
FIG. 6 is a plan view, partially in section, of a threaded nut mounted on the carriage.

The collar 62 and retainer 72 form a unit which is movable longitudinally relative to the jaws 56 such that movement in one direction, i.e., to the left in FIG. 5, causes the jaws 56 to be displaced radially inwardly into clamping engagement with the workpiece 14. Movement of the unit 62, 72 is effected by means of a motor in the form of a fluid cylinder 76 (FIG. 5) mounted above the workpiece turner on a frame structure 77. A rod 78 of that cylinder carries a pin 80 the ends of which are received in the upstanding legs 82 of a yoke 84. The legs 82 are affixed to a shaft 86 which is pivotably mounted in fixed brackets 88 by pins 89. Depending from the shaft 86 are two arms 90 which carry pins 91 that are pivotably received in recesses of the bearing retainer 72.

It will be appreciated that by extending the rod 78 of the cylinder 76, the yoke 84 will be caused to rotate about the axis of the shaft 86, whereupon the arms 90 displace the unit 62, 72 longitudinally (i.e., to the right as viewed in FIG. 2, and to the left as viewed in FIG. 5). Thus, the collar 62 is moved longitudinally relative to the jaws 56 in a manner displacing the jaws 56 radially inwardly to grip the workpiece 14. As a result, the workpiece 14 and the hollow shaft 52 are locked together for common rotation relative to the cylinder 76. The hollow shaft 52 includes an externally threaded end 92 which is threadedly connected to an internally threaded output shaft 94 (FIG. 2) of the hollow-shafted electric motor 49 Hollow shafted motors per se are known (e.g., see U.S. Pat. Mo. 3,167,671), but the combination thereof with a releasable clamp for enabling an output rotor of the motor to selectively grip and rotate a workpiece, and wherein the motor/clamp combination 49, 50 is mounted on a carriage which advances the workpiece through a rollstand, constitutes a low inertia feed system in accordance with the present invention. That is, the present invention eliminates the need to rotate a heavy feedscrew 32 and a heavy gear-laden drive train.

Figure 7:
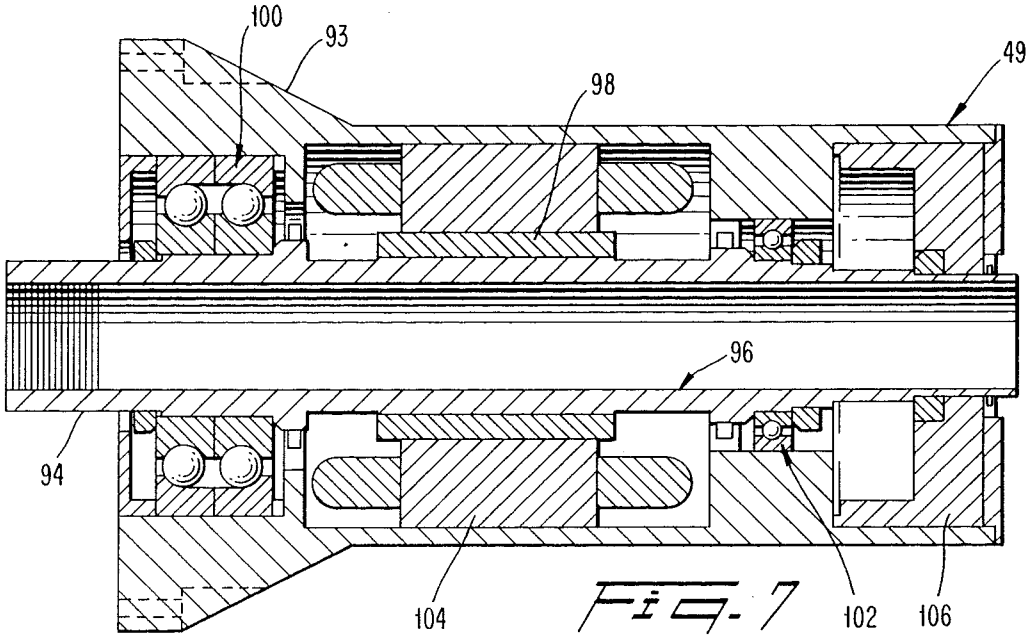
FIG. 7 is a longitudinal sectional view taken through a hollow-shafted motor according to the present invention.

The motor 49 comprises a housing 93 in which a hollow output shaft 94 is rotatably driven (see FIG. 7). The output shaft 94 constitutes a portion of a hollow rotor assembly which includes a magnet 98 affixed to the shaft 96. The shaft 94 is open-ended, i.e., open at both ends and is rotatably mounted in axially spaced bearings 100, 102 disposed within the housing. A stator assembly 104 surrounds the rotor assembly and, when energized, produces rotation of the rotor assembly. A rotor position feedback device 106 is disposed within the housing 93. That device 106, which is of conventional design, produces a signal indicative of the angular position of the rotor assembly, whereby the rotational advancement of the rotor assembly can be detected for de-energizing the motor.

The workpiece 14 extends coaxially through the hollow shaft 52 of the clamp and through the hollow output shaft 94 of the rotor assembly and is adapted to be gripped radially by the jaws 56 to couple the workpiece and the shafts 52, 94 together for common rotation That rotation can be performed with relative precision since the overall mass and thus the overall inertia presented by such a mechanism is relatively low.

A further aspect of the low inertia system according to the invention involves a low inertia mechanism for longitudinally advancing the carriage That mechanism includes a second hollow-shafted electric motor 120, which is identical to the motor 49 and includes an open-ended rotor which constitutes an output shaft 122 of the motor 120. The motor 120 is mounted on the carriage alongside of and parallel to the motor 49. Threadedly attached to the outlet shaft 122 of the motor 120 is a conventional threaded nut 124 through which the stationary feedscrew 32 passes. The nut meshes with the feedscrew and is rotated by the motor 120 to propel the nut, and thus the carriage 12, longitudinally along the guide rails 42, 44. The nut 124 preferably comprises a conventional ball screw which can be obtained for example, from the Rockford Ball Screw Company of Rockford, Ill. The thread of that device is formed by movable balls which are engaged with the outer screw thread of the stationary feedscrew 32 such that the rotation of the nut 124 produces axial displacement of the carriage, while the nut 124 need not be of the ball screw variety, a ball screw produces a minimal amount of friction and thus is well suited to the low inertia system according to the present invention.

Thus, with the clamp 50 actuated to couple the workpiece with the motor 49, actuation of the motor 120 causes the carriage and the workpiece to be longitudinally advanced. Simultaneous actuation of the motor 49 due to a synchronized control of the motors, produces rotation of the workpiece as the workpiece is longitudinally advanced.

In one mode of operation, which may be termed a fixed mandrel mode, the mandrel is held stationary during the rolling operation. Utilized in combination with the motors 49, 120 and the clamp 50 during such a mode of operation are an outlet turner 130, and a rod turner 132 (see FIG. 1). The outlet turner 130 is disposed downstream of the rollstand 15 and preferably comprises a hollow-shafted electric motor/clamp mechanism which is identical to the previously described motor/clamp mechanism 49, 50. The clamp-/motor of the outlet turner grips and rotates the workpiece 14 simultaneously with the motor/clamp mechanism 49, 50. Since, however, the workpiece is being simultaneously advanced in response to rotation of the nut 124, it is necessary that the clamp of the outlet turner 130 be designed to apply less clamping force on the workpiece than the clamp 50, so that relative longitudinal slippage can occur between the workpiece and the clamp of the outlet turner 130.

The rod turner 132 also preferably comprises a hollow shafted electric motor and clamp identical to the motor/clamp mechanism 49, 50. The clamp of the rod turner directly engages the rod 16 and rotates the rod and mandrel synchronously with the rotation of the workpiece.

As noted earlier, the outlet turner and rod turner 130, 132 are used in a fixed mandrel mode of operation In a traveling mandrel mode of operation, however, the outlet turner and rod turner are dispensed with In that case, the jaws 56 are arranged to clamp directly onto the rod 16 at a location behind and in abutment with the rearmost end of the workpiece 14. Thus, the clamp 50 produces rotation of the mandrel, the rod, and the workpiece; the workpiece rotates with the mandrel and rod because a front end of the workpiece has been deformed into tight contact with the mandrel. Simultaneously, the clamp produces longitudinal advancement of the rod, mandrel and workpiece in response to rotation of the nut 124; the abutment of the jaws with the rear end of the mandrel enables the jaws to push the workpiece longitudinally if necessary as well as to prevent the workpiece from being pushed rearwardly during a working stroke of the rollstand.

In order to enable the location of the carriage relative to the end of the workpiece to be made known during a mill loading operation, conventional proximity switches 140, 142 are mounted at front and rear ends of the carriage.

In operation, in a fixed mandrel mode of operation, the workpiece 14 and rod 16 extend through the rollstand 26, and the rollstand is reciprocated to perform a diameter-reducing operation on the workpiece. At the end of each reciprocal cycle, the motor 120 is actuated to rotate the rotor 122 and nut 124 by a preselected angular distance in order to advance the carriage horizontally longitudinally toward the forming zone 28. With the workpiece 14 gripped by the clamp 50, the workpiece is caused to advance longitudinally with the carriage. Simultaneously, the motor 49 is actuated to rotate the rotor 94 by a predetermined angular distance to transmit rotary motion to the workpiece through the clamp 50. In that way, the workpiece is simultaneously advanced longitudinally and rotated at the end of each stroke of the rollstand.

Simultaneously with the rotation of the motors 49, 120, the motors of the outlet turner 130 and the rod turner 132 are rotated due to the synchronous control of those motors.

In the event that the mechanism is operated in a traveling mandrel mode rather than in a fixed mandrel mode, the outlet turner 130 and the rod turner 132 are not used. Rather, the jaws 56 of the clamp 50 are arranged to grip the rod 16 at a location immediately behind the rear end of the workpiece as described earlier.

It will be appreciated that the only components needed to be moved in order to effect such longitudinal and rotary movements of the workpiece are the rotors 94, 122 of the motors 49 and 120, the nut 124, and the rotary parts 52, 56, 62 of the clamp 50. The total weight of those components is virtually negligible as compared for example to the components rotated when carrying out the movements according to the prior art, i.e., the screw 32 and a gear-laden drive train interconnecting a motor with the screw and with a workpiece-turning device on the carriage As a result, the present invention enables the movements to be started and stopped essentially instantaneously to effect the movements with a high degree of precision. Furthermore, the system costs less to construct and maintain, and occupies less space due to the absence of a drive train.

Although the present invention has been described in connection with a preferred embodiment thereof, it will be appreciated by those skilled in the art that additions, deletions, substitutions, and modifications not specifically described may be made without departing from the spirit and scope of the invention as defined in the appended claims.

What is claimed is:

1. In a rocker mill including a rollstand and repositioning means for repositioning a longitudinally elongated member which includes a workpiece extending through said rollstand, said supporting means comprising:

a stationary feedscrew oriented in a longitudinal direction, guide means oriented in said longitudinal direction, a carriage mounted on said guide means for movement in said longitudinal direction toward said rollstand, a first hollow-shafted electric motor mounted on said carriage and including a first hollow open-ended rotor through which said stationary feedscrew passes, a threaded nut through which said stationary feedscrew passes, said threaded nut being connected to said first hollow-shafted electric motor to be rotated thereby relative to said feedscrew in order to move said carriage longitudinally along said guide means, a second hollow-shafted electric motor mounted on said carriage and including a second hollow open-ended rotor through which the elongated member is adapted to pass, a clamp through which the elongated member is adapted to pass, said clamp including displaceable clamp jaws connected to said second rotor for rotation therewith, and clamp actuating means mounted on said carriage and operably connected to said clamp jaws for displacing said clamp jaws into clamping engagement with the elongated member for transmitting rotary movement thereto from said second rotor and for transmitting longitudinal movement thereto from said threaded nut.

2. A rocker mill according to claim 1, wherein said clamp actuating means includes a clamp actuating motor, a first force transmitting member connected to said motor for being displaced thereby, a second force transmitting member connected to said first force transmitting member for being displaced thereby and connected to said clamping jaws for urging said clamping jaws radially into clamping engagement with the elongated member, and bearing means for permitting rotation of said second force transmitting member relative to said first force transmitting member about an axis which coincides with an axis of rotation of said second rotor.

3. A rocker mill according to claim 2, wherein said clamping jaws comprise a plurality of circumferentially spaced wedge-shaped jaws arranged in a circular pattern about said axis, said second force-transmitting member comprising an annular collar surrounding said jaws and adapted to be displaced in the longitudinal direction by said first force transmitting member.

4. A rocker mill according to claim 3, wherein said clamp actuating motor comprises a fluid cylinder.

5. A rocker mill according to claim 4, wherein said clamp comprises a hollow shaft through which the elongated member is adapted to extend, said shaft including circumferentially spaced recesses through which said jaws extend, and a helical thread at one end of said shaft coupled to a helical thread at an end of said second rotor.

6. A rocker mill according to claim 1 including an outlet turner comprising a third hollow shafted motor and associated clamp disposed behind said rollstand for receiving said elongated member.

7. A rocker mill according to claim 1, wherein said elongated member comprises a hollow workpiece and a mandrel received telescopingly in said workpiece.

* * * * *